US008018173B2

(12) United States Patent
Shackle et al.

(10) Patent No.: US 8,018,173 B2
(45) Date of Patent: Sep. 13, 2011

(54) BALLASTS FOR FLUORESCENT LAMPS

(75) Inventors: Peter W. Shackle, Rolling Hills, CA (US); Zhiqing Wu, Torrance, CA (US)

(73) Assignee: Fulham Company Ltd., Kowloon (HK)

( * ) Notice: Subject to any disclaimer, the term of this patent is extended or adjusted under 35 U.S.C. 154(b) by 1250 days.

(21) Appl. No.: 11/469,863

(22) Filed: Sep. 3, 2006

(65) Prior Publication Data

US 2008/0054816 A1 Mar. 6, 2008

(51) Int. Cl.
*H05B 39/04* (2006.01)
*G05F 1/00* (2006.01)

(52) U.S. Cl. ..... 315/209 R; 315/291

(58) Field of Classification Search ..... 315/291, 315/307, 244, 209 R, DIG. 2, DIG. 4, DIG. 5
See application file for complete search history.

(56) References Cited

U.S. PATENT DOCUMENTS

| | | | | |
|---|---|---|---|---|
| 4,710,682 | A | 12/1987 | Zuchtriegel | |
| 5,436,529 | A | 7/1995 | Bobel | |
| 5,550,433 | A * | 8/1996 | Tobler | 315/94 |
| 5,747,941 | A | 5/1998 | Shackle et al. | |
| 5,925,990 | A | 7/1999 | Crouse et al. | |
| 6,144,169 | A * | 11/2000 | Janczak | 315/224 |
| 6,181,079 | B1 * | 1/2001 | Chang et al. | 315/247 |
| 6,274,987 | B1 * | 8/2001 | Burke | 315/307 |
| 6,291,944 | B1 * | 9/2001 | Hesterman et al. | 315/224 |
| 6,359,387 | B1 * | 3/2002 | Giannopoulos et al. | 315/46 |
| 6,366,032 | B1 | 4/2002 | Allison et al. | |
| 6,420,838 | B1 | 7/2002 | Shackle | |
| 6,452,344 | B1 * | 9/2002 | MacAdam et al. | 315/307 |
| 6,906,473 | B2 * | 6/2005 | Alexandrov | 315/224 |
| 7,015,652 | B2 | 3/2006 | Shi | |
| 7,042,161 | B1 | 5/2006 | Konopka | |
| 2003/0189411 | A1 | 10/2003 | Sridharan | |
| 2005/0093477 | A1 * | 5/2005 | Shi | 315/224 |
| 2005/0168167 | A1 | 8/2005 | Yu et al. | |
| 2006/0244395 | A1 * | 11/2006 | Taipale et al. | 315/277 |

OTHER PUBLICATIONS

Stmicroelectronics, AN993 Application Note, Electronic Ballast with PFC Using L6574 and L6561, 2004, pp. 1-20.
Yang, Bo; Topology investigation of front end DC/DC converter for distributed power system; Dissertation; 2003, Chapter 4, pp. 94-141.
Stmicroelectronics Group of Companies; L6574 CFL/TL Ballast Driver Preheat and Dimming; Sep. 2003; pp. 1-10.

* cited by examiner

*Primary Examiner* — Douglas W Owens
*Assistant Examiner* — Minh D A
(74) *Attorney, Agent, or Firm* — Henricks, Slavin & Holmes LLP

(57) ABSTRACT

Circuits are disclosed, for example for driving fluorescent lamps, and such circuits may form part of a ballast. First and second sensing circuits can apply respective signals to a control circuit as a function of an end-of-lamp life condition and of the number of re-strike attempts.

68 Claims, 9 Drawing Sheets

BALLASTS FOR FLUORESCENT LAMPS

BACKGROUND

1. Field

This relates to circuits for fluorescent lamps, including ballast circuits having sensing and/or control circuits that operate in part in a manner relating to incipient failure of the lamp and which produce a limited number of multiple re-strikes of a lamp.

2. Related Art

Power supply circuits such as ballasts for fluorescent lamps may include integrated circuits. These ballasts are electronic ballasts, and they are widely used to power lighting circuits, including conventional fluorescent lamps, compact fluorescent lamps, and other fluorescent lighting components. Electronic ballasts are capable of performing a number of functions, which may include pre-heating of the lamp filaments, driving inverter circuits for providing AC power to the lamp, and various shutdown functions. Some proprietary integrated circuits may also include end-of-lamp life shutdown circuits, automatic ballast reset upon lamp replacement and control of the number of re-start attempts before shutting off the ballast.

Some ballasts may be designed with commercially available driver chips. Additional circuits are provided to give end-of-lamp life detection, and other circuits may provide other functions. End-of-lamp life detection may sense slightly increased voltage (for example about 10%) across the lamp for a prolonged time, which may indicate an aging lamp, or may sense a very high voltage (for example about four times higher) across the lamp for a brief period (for example about 50 microseconds), which may indicate a missing lamp or a degassed lamp. Increasing voltage across the load will typically cause a ballast to increase the power delivered to the load. Sustained higher power delivery may cause the ballast to over heat or possibly fail, or the lamp to shatter.

SUMMARY

Methods and apparatus for driving a load such as a fluorescent lamp provide an integrated circuit, a circuit for sensing increased voltage across an output for a load, and a circuit for limiting re-strikes. The methods and apparatus provide a simple configuration for sensing end-of-lamp life conditions and a simple configuration for limiting re-strikes.

One example of a method and apparatus for driving a load, for example a fluorescent lamp, includes a control circuit and a series resonant circuit, which produces an alternating current signal for driving the load. A sensing resistor is in series with a resonant capacitor in the series resonant circuit. The sensing resistor can provide a voltage that is proportional to the peak-to-peak voltage across the lamp. The magnitude of the voltage across the lamp can then be used to reduce or remove current from the lamp when the voltage across the lamp reaches or exceeds a voltage level.

In another example of a method and apparatus for driving a load, for example a fluorescent lamp, a control circuit controls a series resonant circuit for applying an alternating current signal to a load. An end-of-life lamp life detection circuit is coupled to the series resonant circuit, and a separate monitoring circuit monitors the re-strikes. If the lamp fails to start, the alternating current signal can be removed from the load, for example by the control circuit, after a number of re-strike attempts.

In a further example of a method and apparatus for driving a load, for example a fluorescent lamp, a control circuit controls a resonant circuit for applying an alternating current signal to the load and first and second sensing circuits apply respective signals to the control circuit. The first sensing circuit applies a first signal to a first part of the control circuit, and the second sensing circuit applies a second signal to a second part of the control circuit. For example, the first and second signals can be applied to different inputs of the control circuit. Either or both of the first and second signals can be used to stop driving the load. In one example, the first sensing circuit can be used to sense an AC component for driving the load, for example to monitor the number of re-strike attempts on the load, and in another example, the second sensing circuit can be used to sense a DC component, for example to check for an end-of-lamp life condition.

In another example of a method and apparatus for driving a load, for example a fluorescent lamp, a control circuit controls an inverter circuit which feeds a resonant circuit, the output of which drives the load. A first sensing circuit senses a parameter in the inverter circuit and applies a first signal to the control circuit, and a second sensing circuit senses a parameter in the resonant circuit and applies a second signal to the control circuit. In one example, the first and second sensing circuits are separate circuits, and in a further example, the first and second sensing circuits apply respective signals separately to the control circuit. In one example, the first signal may be applied to the control circuit as a function of an AC component from the inverter circuit, and the second signal may be applied to the control circuit as a function of a DC component from the resonant circuit. In another example, a third sensing circuit, for example distinct and separate from the first and second sensing circuits, senses a parameter in the inverter circuit. In one example, the third sensing circuit senses a parameter such as a fast AC component. The third sensing circuit can also apply an output to the control circuit, and the output may be applied to a same or a different input as that from one of the other sensing circuits. For example, a signal from sensing a fast AC component may be applied to an input of the control circuit different from that of a slow AC resultant and that resulting from the sensing of a DC component from the resonant circuit.

In an additional example of a method and apparatus for driving a load, for example a fluorescent lamp, a control circuit controls an inverter circuit, which drives a resonant circuit for driving a load. If the load reaches the end of its useful life, the control circuit is preferably shut off. Alternatively, or in addition, if the load has reached the end of its useful life, or has been removed, the control circuit can be turned off after a number of attempts to restart or re-strike the load. An AC sensing circuit can be used to monitor the load to see if a too many re-strike attempts have occurred. The AC sensing circuit can then apply a first signal to the control circuit so that the control circuit can determine when the driving current can be removed from the load. A DC sensing circuit can be used to monitor the load to see if it is approaching the end of its useful life, for example by putting an upper limit on the magnitude of the voltage that can be applied to the load. The DC sensing circuit can then apply a second signal to the control circuit so the control circuit can determine when the driving current can be removed from the load. In one example, the first and second signals are applied separately to the control circuit, and in another example, the first and second signals are applied to different parts of the control circuit.

In one example of a method, a ballast is operated by a series resonant circuit receiving a driving signal and wherein a sensing circuit senses a high voltage from a point between the series resonant circuit and a sensing resistance. A relatively longtime constant can be used in sensing the voltage. The sensed voltage can be used to determine one or more of an AC end of life, DC end of life and pulse accumulation. The sensed voltage can be determined from a combination of a series resonant capacitor and a resistance sensor, for example from a point between the series resonant capacitor and a resistor in series with the series resonant capacitor. The sensed voltage can be sensed using an integrating capacitor, a threshold voltage sensor for example a Zener diode or a diode combination, a resistance, or other components.

In another example of the foregoing method, a control circuit can be used to immediately shut down the ballast based on the sensed voltage. In an example where the sensed voltage is used to determine pulse accumulation, AC end of life and/or DC end of life can be determined through one or more signals on an oscillation circuit. In example where the sensed voltage is used to determine DC end of life, AC end of life and/or pulse accumulation can be determined through one or more signals on an oscillation circuit. Additionally, these steps can be carried out without the use of a microprocessor, for example using analog components. Furthermore, of the sensing for pulse accumulation, AC end of life and DC end of life, two or more of the sensing steps can be carried out on discrete and separate circuits.

These and other examples are set forth more fully below in conjunction with drawings, a brief description of which follows.

DETAILED DESCRIPTION

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of circuits and of methods of using the circuits are described. Depending on what feature or features are incorporated in a given structure or a given method, benefits can be achieved in the structure or the method. For example, sensing circuits in series with a series resonant circuit may allow sensing possible end-of-lamp life conditions, and a separate re-strike monitoring circuit may provide more flexibility in operation without needing more expensive components.

These and other benefits will become more apparent with consideration of the description of the examples herein. However, it should be understood that not all of the benefits or features discussed with respect to a particular example must be incorporated into a circuit, component or method in order to achieve one or more benefits contemplated by these examples. Additionally, it should be understood that features of the examples can be incorporated into a circuit, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of a number of circuit configurations and of methods of making and using the circuits are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

Figure 1:
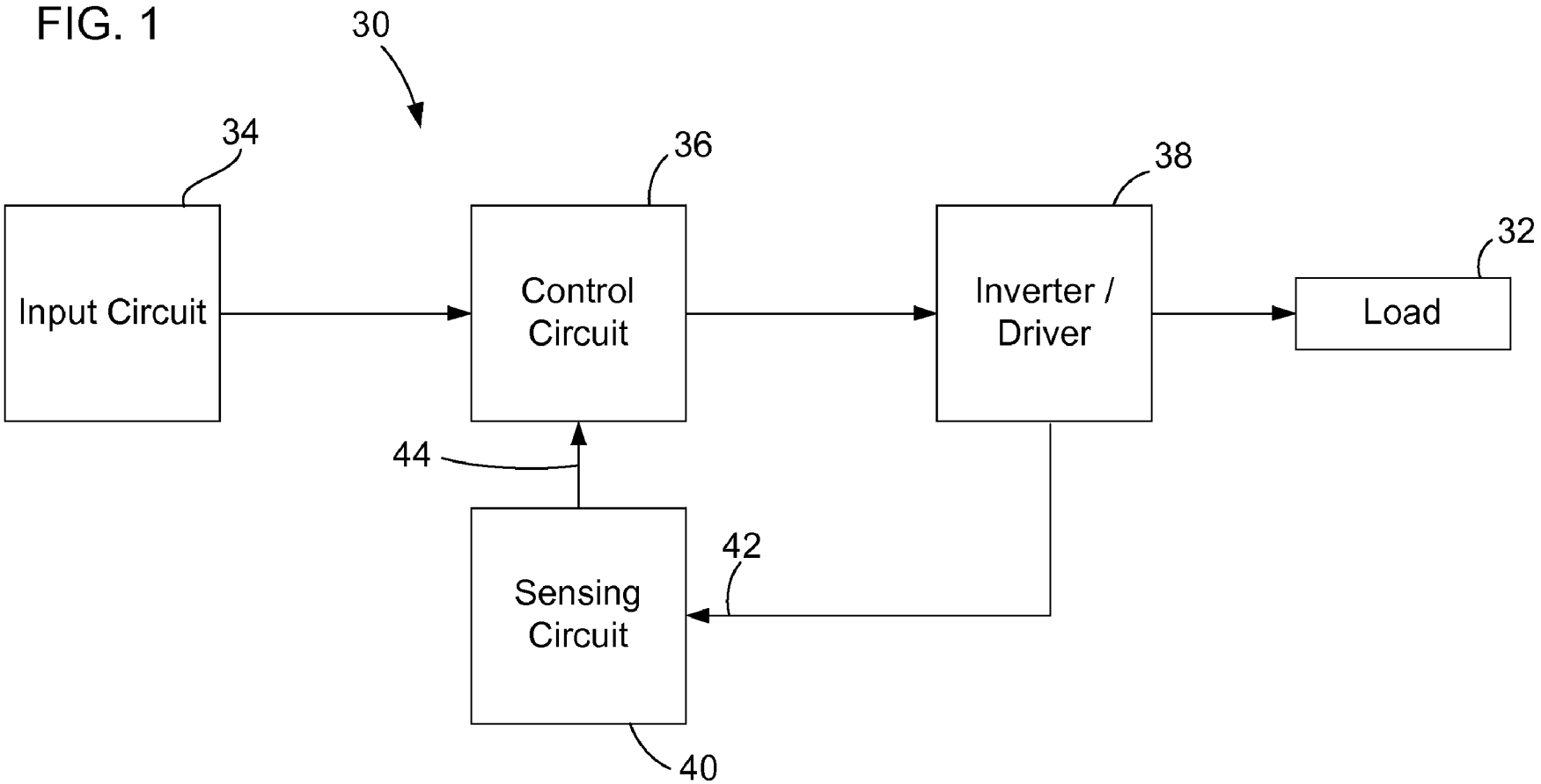
FIG. 1 is a schematic and block diagram of a ballast and a driving circuit for a light source and a method for driving a load such as a light source.

In one example of methods and apparatus described herein, a ballast circuit 30 or other circuit for driving a load 32 may include an alternating current or other input 34 (FIG. 1; the load 32 does not form part of the ballast). In the present examples described herein, it will be assumed that the AC input 34 receives alternating current input from normal power mains, supplying 120 volts, 240 volts or 277 volts at 50 or 60 Hz. However, if the AC input levels are significantly different from these, circuit component values can be adjusted in the design so that the ballast can easily accommodate different voltages other than these. However, the description herein assumes that the AC input conforms to one of the commonly available inputs, namely 120 volts, 240 volts or 277 volts at which most power systems are designed. Therefore, the present examples will be considered in the context of any of the foregoing examples, while it should be understood that other examples are possible.

In the present examples, the ballast 30 includes a control circuit 36 coupled to the AC input. The control circuit 36 controls an inverter/driver circuit 38, the output of which is applied to the load 32. The control circuit can have a number of configurations, but the example described herein is a control circuit for a ballast driver such as may be used for preheating and dimming functions. One such control circuit is the L6574 of STMicroelectronics, described more fully below. The load 32 in the present examples will be taken to be a conventional fluorescent lamp, for example a fluorescent tube lamp, compact fluorescent lamp or other light source, but it should be understood that other loads can be driven by inverter/driver 38. An inverter can be a series resonant inverter such as that described herein. In the example represented by FIG. 1, the ballast 30 includes a sensing circuit 40. The sensing circuit 40 can take a number of configurations, but in the present examples, it senses or monitors one or more parameters 42 of the inverter/driver 38. In the example shown in FIG. 1, the sensing circuit 40 applies through path 44 one or more signals to the control circuit 36 to allow the control circuit 36 to adjust or control the inverter/driver 38 as desired. In one example, the sensing circuit 40 senses a first parameter in the inverter/driver circuit 38 and applies a first signal to the control circuit. The first parameter in one example can be a function of an AC component such as from an inverter circuit, and in another example can be a function of a DC component such as from a resonant circuit. In another example, the sensing circuit 40 senses an AC component and senses a DC component and applies two resultant signals to the control circuit 36. In a further example, the sensing circuit 40 senses an AC component and senses a DC component and applies signals to two different portions of the control circuit 36. However, other ways of sensing parameters in an inverter/driver circuit and applying resultant signals to a control circuit can also be used.

In the configuration of the circuit shown in FIG. 1, when the sensing circuit 40 determines that a characteristic or parameter of the inverter/driver 38 has changed to a selected characteristic, crossed a selected threshold or is within a selected range, for example where a voltage magnitude is too high, the sensing circuit 40 applies a signal to the control circuit 36. The sensing circuit 40 in one example indicates that the lamp is approaching the end of its useful life, and the sensing circuit 40 in another example indicates that a number of re-strikes has occurred. In another example, the sensing circuit 40 senses end-of-lamp life characteristics with one sensing circuit and senses a number of re-strikes with another sensing circuit.

Figure 2:
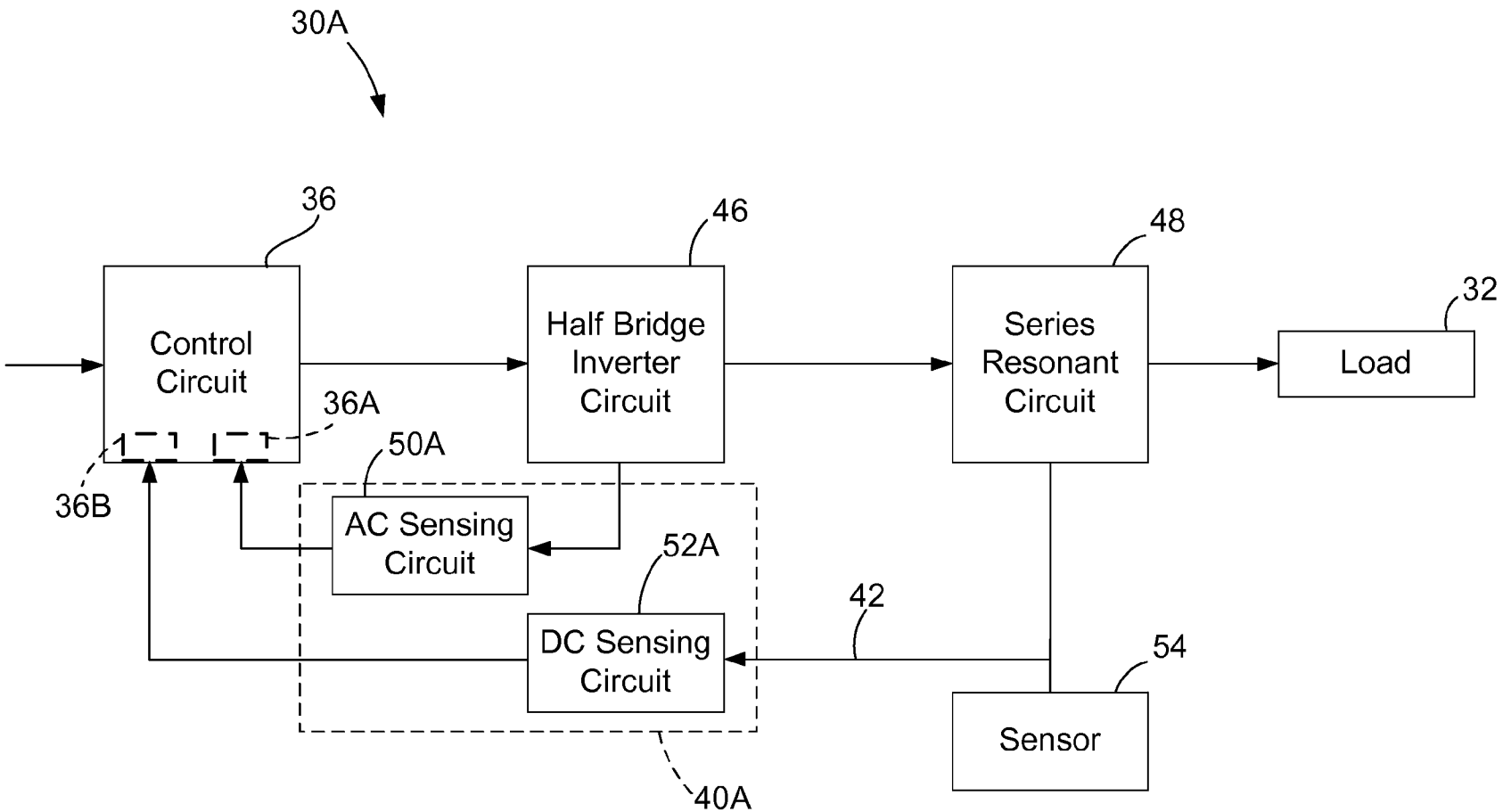
FIG. 2 is a schematic and block diagram of a ballast circuit having an end-of-lamp life circuit and a separate re-strike monitoring circuit.

In an alternative configuration of a ballast and a method for controlling a ballast, a ballast can include a ballast circuit 30A (FIG. 2) receiving an AC input in a control circuit 36, such as that described above with respect to FIG. 1. The control circuit 36 controls part of a half bridge inverter circuit 46, which feeds a series resonant circuit 48. The half bridge inverter circuit also can be a full bridge inverter circuit or a Class E resonant circuit. In the example of FIG. 2, the sensing circuit 40A includes two sensing circuits 50A and 52A. The two sensing circuits 50A and 52A may be common but are preferably two discreet and separate sensing circuits. The two sensing circuits 50A and 52A may apply their respective signals to a common input on the control circuit 36, or they preferably apply respective signals to the control circuit 36 at two discreet and separate inputs (36A and 36B) for the control circuit 36. In the example shown in FIG. 2, the first sensing circuit 50A can be used to sense a high frequency parameter in the inverter circuit. The first sensing circuit 50A is an AC sensing circuit sensing a parameter or configuration of the half bridge inverter circuit 36. The first sensing circuit 50A applies a first signal to the control circuit 36, so the control circuit 36 can adjust, modify or shutdown the inverter circuit 38. For example, the AC sensing circuit 50A can monitor any re-strikes applied to the lamp, for example by monitoring the voltage of the half bridge inverter circuit 36 for a length of time. Integration of the voltage over time can give an indication of the number of re-strikes applied to the lamp. If the number of re-strikes applied to the lamp exceeds a certain value, the inverter circuit can be shutdown through the control circuit 36.

In the example shown in FIG. 2, the second sensing circuit 52A is a DC sensing circuit sensing a parameter or configuration of the series resonant circuit 38. The second sensing circuit 52A applies a second signal to the control circuit 36 (at 36B), so the control circuit 36 can adjust, modify or shutdown the inverter circuit 38. For example, the DC sensing circuit 52A can monitor the voltage being applied to the load, for example by monitoring the magnitude of the voltage of the series resonant circuit 48. The magnitude of the voltage can give an indication of whether the lamp has reached the end of its useful life. If the magnitude of the voltage of the resonant circuit exceeds a certain value, indicating that the lamp has reached the end of its useful life, the inverter circuit can be shutdown through the control circuit 36.

The second sensing circuit can have a time constant associated with it. The time constant can be used to provide a desired delay in responding to a sensed magnitude of the voltage. The time constant can be selected to have a relatively long time constant, for example greater than one minute. Other time constants can also be selected.

In the ballast circuit 30A of FIG. 2, the sensing circuits, such as the two sensing circuits 50A and 52A, can be configured to produce a signal substantially instantaneously at the control circuit 36 once the sensed parameter reaches a predetermined condition. For example, once the AC sensing circuit 50A determines that the selected number of re-strikes has occurred, the AC sensing circuit 50A can immediately place a signal on the control circuit 36. As a result, the control circuit can respond immediately when the re-strike number has been reached, for example to shut down the inverter. In another example, once the DC sensing circuit determines that the sensed voltage exceeds a predetermined value, the DC sensing circuit can respond immediately by placing a signal on the control circuit 36, allowing the control circuit 36 to immediately shut down the inverter, for example. Such immediate responses can be easily implemented using analog circuits, as discussed more fully herein.

Figure 3:
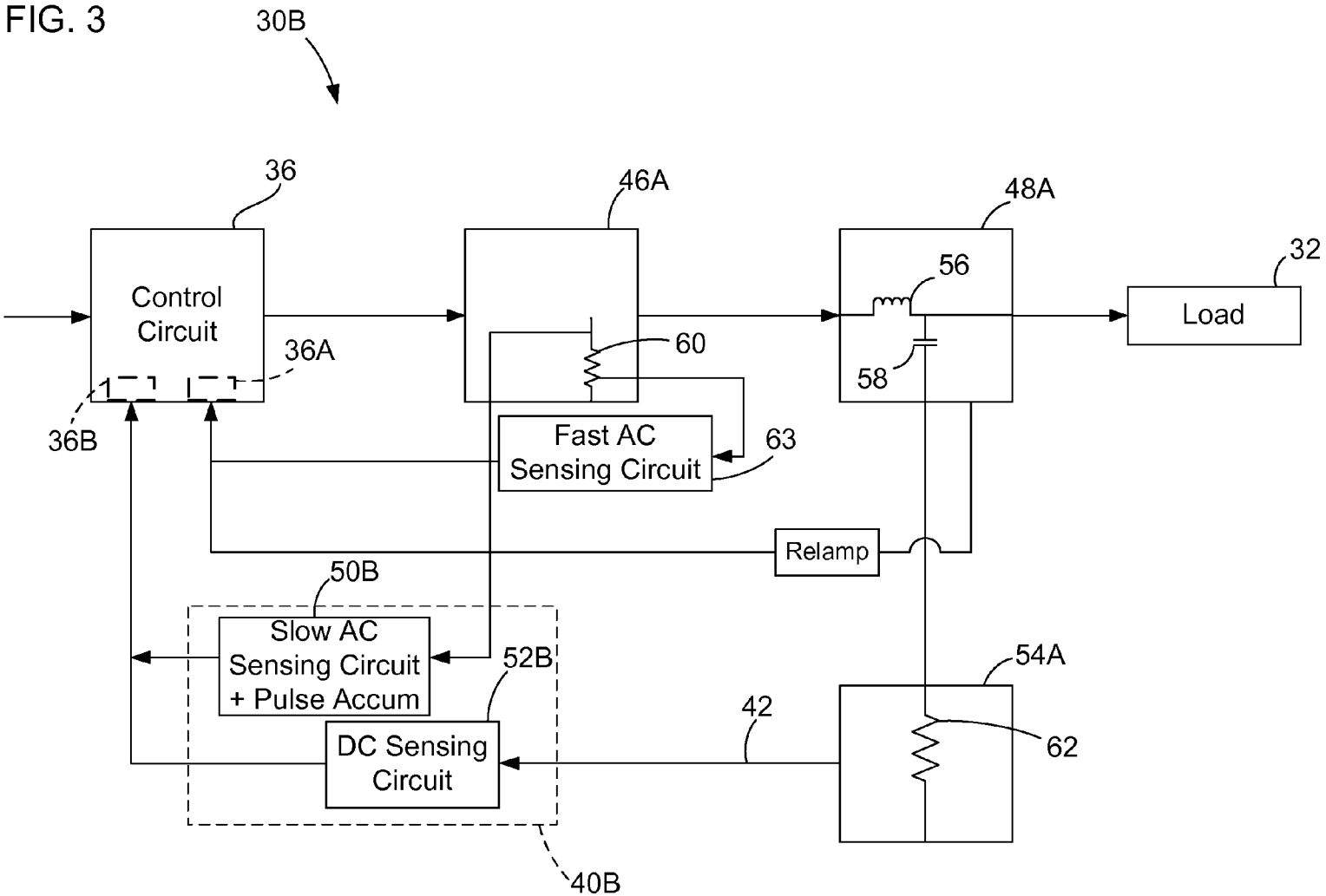
FIG. 3 is a schematic and block diagram of an example of a ballast circuit having an end-of-lamp life circuit and a separate re-strike monitoring circuit.

In the example shown in FIG. 3, the components with the same reference numerals have the same structure and function as previously described, except as otherwise noted. In this example of a ballast 30B the control circuit 36 controls part of a half bridge inverter circuit 46A which feeds a series resonant circuit 48A having an inductor 56 and capacitor 58. In this example, the half bridge inverter circuit 46A includes a sense resistor 60 to which is coupled the AC sensing circuit 50B for sensing the length of time that re-strikes are applied to the lamp, also considered a pulse accumulation circuit. When the voltage at the upper junction of the sense resistor 60 reaches a predetermined level for a predetermined length of time, for example indicating that re-strikes have been applied to the lamp for a given length of time, the sensing circuit sends a first signal to the input 36A of the control circuit 36. The control circuit 36 thereafter shuts down the inverter circuit.

The inductor 56 and capacitor 58 form a series resonant circuit 48A. The sensor 54A includes a sense resistor 62 for monitoring the current being applied to the load. The DC sensing circuit 52B, which in this example is the same as the DC sensing circuit 52A in FIG. 2, is coupled between the capacitor 58 and the resistor 62 for sensing the current through the resonant capacitor circuit in the resonant circuit 48A. When a voltage between the capacitor 58 and resistor 62 reaches a predetermined level, for example indicating that the lamp has reached the end of its useful life, the sensing circuit 52B sends a second signal to the input 36B of the control circuit 36. The control circuit 36 thereafter shuts down the inverter circuit.

A Fast AC Sensing Circuit 63 is coupled between the half bridge inverter circuit 46A and the control circuit 36. The Fast AC Sensing Circuit 63 senses momentary excessive voltages, such as when the lamp is unexpectedly removed or broken. The Fast AC Sensing Circuit 63 is coupled to the input 36A for sending a signal to the control circuit 36. The control circuit 36 thereafter shuts down the inverter circuit.

Figure 4:
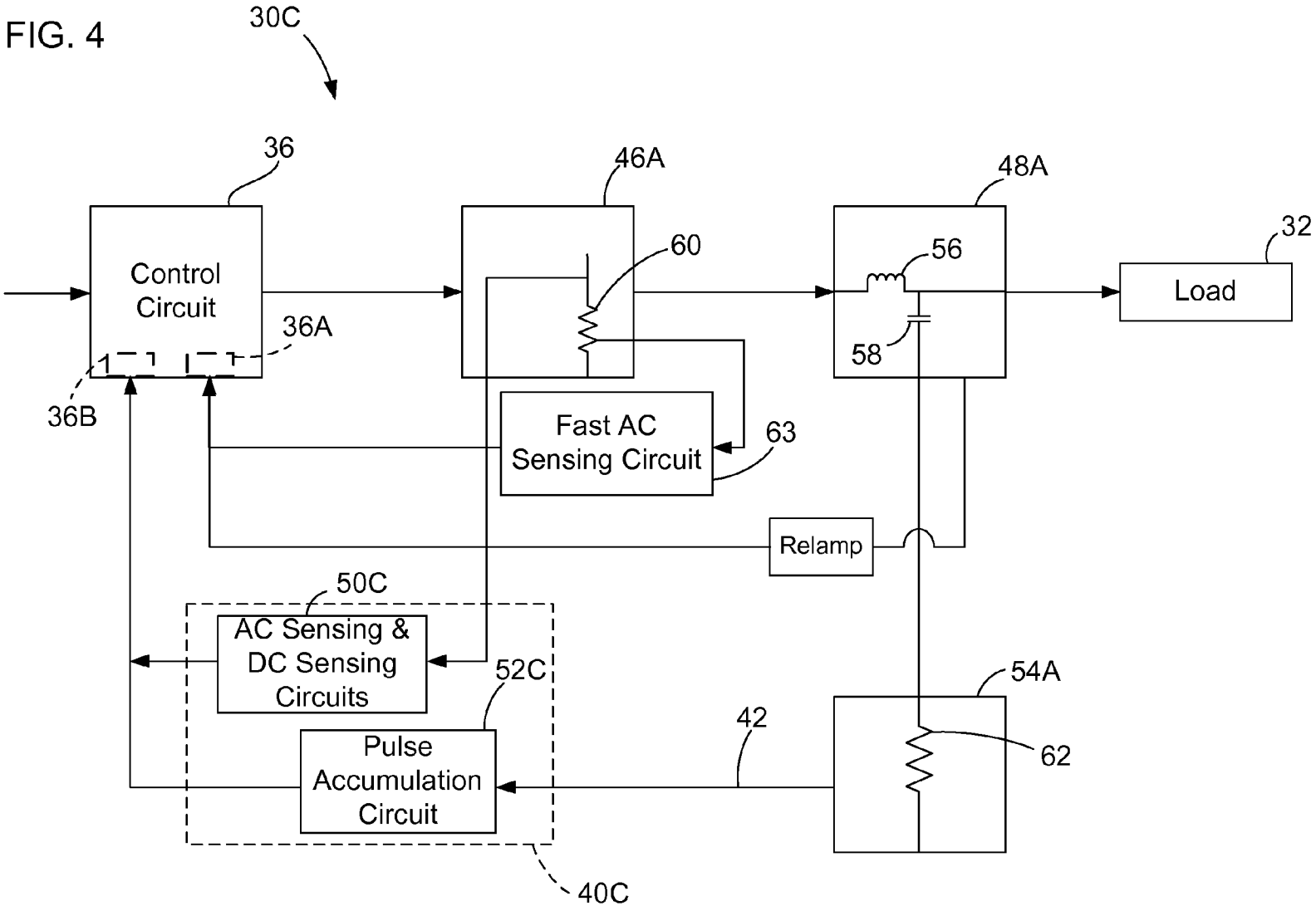
FIG. 4 is a schematic and block diagram of another example of a ballast circuit having an end-of-lamp life circuit and a separate re-strike monitoring circuit.

In the example shown in FIG. 4, the components with the same reference numerals have the same structure and function as previously described, except as otherwise noted. In this example of a ballast 30C, the control circuit 36 controls part of a half bridge inverter circuit 46A which feeds a series resonant circuit 48A having an inductor 56 and capacitor 58. In this example, the half bridge inverter circuit 46A includes a sense resistor 60 to which is coupled the AC sensing and DC sensing circuits 50C for sensing the AC end-of-life and for sensing the DC end-of-life for the lamp. The AC portion of the AC and DC sensing circuits 50C senses a high frequency parameter in the inverter circuit 46A. When the voltage at the junction of the sense resistor 60 reaches a predetermined level for a predetermined length of time, for example indicating that the voltage across the lamp exceeds a predetermined threshold and indicating that the lamp has reached the end of its useful life, the sensing circuit sends a first signal to the input 36B of the control circuit 36. The control circuit 36 thereafter shuts down the inverter circuit.

The inductor 56 and capacitor 58 form a series resonant circuit 48A. The sensor 54A includes a sense resistor 62 for monitoring the current being applied to the load. A Pulse Accumulation Circuit 52C is coupled between the capacitor 58 and the resistor 62 for sensing the length of time that re-strikes are applied to the lamp. When a voltage between the capacitor 58 and resistor 62 reaches a predetermined level over a length of time, for example indicating that the absence of a lamp, the sensing circuit 52C sends a second signal to the input 36B of the control circuit 36. The control circuit 36 thereafter shuts down the inverter circuit.

In this example also, a Fast AC Sensing Circuit 63 is coupled between the half bridge inverter circuit 46A and the control circuit 36. The Fast AC Sensing Circuit 63 senses momentary excessive voltages, such as when the lamp is unexpectedly removed or broken. The Fast AC Sensing Circuit 63 is coupled to the input 36A for sending a signal to the control circuit 36. The control circuit 36 thereafter shuts down the inverter circuit.

Considering another example of a ballast circuit in more detail, a ballast circuit 64 (FIGS. 5A-5B) can be coupled at an output 66 to one or a pair of parallel-connected lamps (not shown) to be driven by the ballast. The lamps do not form part of the ballast, but they represent the load to be driven by the ballast. The ballast includes an input circuit 68 to be coupled to a conventional power source, such as from a utility or other power source. The ballast 64 also includes an inverter circuit 70 and a series resonant circuit 71 having suitable output conductors at the output 66 to be coupled to the conductors of a lighting circuit, such as the terminals in a conventional lamp socket (not shown). In other lighting system configurations, the ballast circuit can be hard-wired to the lighting unit or units, or coupled to the lighting system in known configurations.

In this specific example of the ballast 64 (FIGS. 5A-5B), the ballast includes a power factor correction circuit, in this example an active power factor correction circuit having a main power factor correction circuit 72 and a power factor correction control circuit 74. As in conventional ballasts having power factor correction, the power factor correction circuit 72 increases the power factor of the ballast, and serves as a boost circuit between the input circuit 68 and the inverter circuit 70. The circuit 72 is controlled by the power factor control circuit 74. In the present example, the two circuits 72 and 74 form the power factor correction circuit for the ballast.

The input circuit 68 includes input conductors for receiving AC voltage input on a hot and neutral with a fuse F101 to provide protection against a catastrophic short circuit failure inside the ballast. A metal oxide varistor voltage limiting protection device spans the hot and neutral before the inductor L101. The output of the inductor L101 provides input to a conventional full wave bridge rectifier circuit composed of diodes D101-D104. The full wave rectifier bridge produces a rectified current signal on the rectifier output rail 76 and on the common bus 78, or the return DC bus at approximately 170 volts.

The rectified current signal is applied to the power factor correction circuit 72, which produces a boosted output voltage Vdc on the output rail 80. The output voltage is applied to one side of the inverter circuit 70, the other side of which is coupled to the common bus 78. Power factor correction is controlled by the integrated circuit IC101 in the control circuit 74. The integrated circuit IC101 may be the IC number L6561 available from STMicroelectronics or a similar circuit. The components of the power factor correction main circuit 72 and the power factor correction control circuit 74 are arranged and coupled together in a manner similar to that described in Application Note AN991, incorporated herein by reference.

The inverter circuit 70 is a half bridge inverter circuit that receives output voltage Vdc and converts it to a high frequency AC signal to be applied to the series resonant circuit 71 for producing an output for driving the lamp or lamps representing the load for the ballast. The inverter can also be a full bridge inverter circuit or a class E resonant circuit.

The ballast circuit 64 also includes a ballast preheat and dimming control circuit 82. The control circuit 82 applies preheat current to the lamp and also applies restrike voltage to the lamp to try to restart the lamp, if the lamp does not start on the first try. In the example shown in FIG. 5B, the control circuit 82 is coupled between the inverter circuit 70 and the series resonant circuit 71, and provides an input or control signal to the series resonant circuit. Other forms of input can also be applied by the control circuit 82 to the resonant circuit 71. While the control circuit 82 is shown in FIG. 5B as a number of components forming a functional unit within the dotted line identified as 82, it should be understood that the control functions and components can be carried out or configured in a number of ways without detracting from the operation and functions of the circuit. The structures and functions of the various components in the control circuit 82 will be understood more fully from the discussion below.

The control circuit 82 can be conveniently implemented using an STMicroelectronics L6574 chip (the specification sheet from STMicroelectronics entitled CFL/TL Ballast Driver Preheat and Dimming is incorporated herein by reference). The control circuit 82 provides starting and re-start functions, conventional for ballast circuits using this chip. The control circuit 82 has its VS input coupled to the high voltage rail 76 through resistors R205 and R206. R206 is a low value resistor used to prevent unduly large current surges ever going into U202. The node between R205 and R206 is known as the low voltage rail since its voltage is clamped to less than 18V by a zener inside U202. Resistor R205 is used on initial startup to take the high voltage from the high voltage rail to charge capacitor C210. When the voltage reaches approximately 12 volts, current passes through resistor R206 to power the control circuit 82 by turning on the chip U202. The charge on the capacitor C210 can be used for several milliseconds to power the chip until the charge pump through capacitor C206 can begin powering the chip. R217 is used to feed current from the low voltage rail to the circuit which senses continuity through the lamp filaments to detect lamp replacement. C212 is known as a DC blocking capacitor and ensures that only ac signals are passed from the inverter to the lamp.

The high side voltage output (HVG, pin 15) of the control circuit 82 is coupled to the gate of MOSFET Q201 in the inverter circuit 70 through resistor R215 in parallel with diode network D210. The low side voltage output (LVG, pin 11) of the control circuit 82 is coupled to the gate of MOSFET Q202 in the inverter circuit 70 through resistor R216 in parallel with diode network D211. MOSFETs Q201 and Q202 form the inverter circuit 70, with their source—drain circuits in series with the high voltage rail 80. The output of the inverter circuit 70 is capacitively coupled by C212 to the primary winding of the resonant inductor L201 in the series resonant circuit 71. The other end of the primary is coupled to one of the red conductors in the output 66 and to the series resonant capacitor C219, and the other side of the red conductor is coupled through resistors R218 and R218A to windings in the inductor L201 coupled to one of the blue conductors in the output 66. The other blue conductor in the output 66 is coupled to a blocking capacitor C216 on the low voltage rail 78 and to the anode of diode D212. The series resonant capacitor C219 is coupled to the common rail 78 through a resistor network having resistors R221 and R221A. The resistor R218 is also coupled to blocking capacitor C215 on the common rail 78.

The ballast circuit 64 also includes a sensor circuit 84 coupled to the series resonant circuit 71. The sensor circuit 84 in the present example is coupled in series with the series resonant capacitor C219, and in the example shown in FIG. 5B, the sensor circuit is connected directly to the resonant capacitor. It is not parallel to or coupled across the resonant capacitor, and in this example it is not capacitively coupled across the load. The sensor circuit 84 provides any indication of the end-of-life condition of the lamp, which in turn is an indication of both rectifying end of life and symmetric (in other words high AC voltage) end of life. The sensor circuit 84 is an effective sensing circuit for sensing one or more parameters indicating end of lamp life. The sensor circuit 84 can be used to integrate in an analog way the rectified magnitude of the voltage on the resonant capacitor.

In the example shown in FIG. 5B of the ballast circuit 64, the sensor circuit 84 is formed from one or more resistors coupled in series between the series resonant capacitor C219 and the low voltage rail 78. The values of the resistors are selected so as to provide the desired threshold of the rectified amplitude of the current through the lamp. They can be selected to give the desired result, without regard to values of other components in the system. Additionally, using one or more resistors to achieve the desired monitoring of the lamp for end-of-life conditions is a relatively simple and direct method for doing so. A sensing circuit, described more fully below can then take the signal from the resistor(s) in the sensor 84 and integrate them to produce an indication of end of lamp life.

The other blue conductor in the output 66 is coupled through diode D212 through series resistors R222 and R222A and R226 to a parallel network of capacitor, resistor and a Zener diode. Capacitor C217, resistor R224 and Zener diode ZD203 are coupled between the resistor R226 and the common rail 78. The resistor R226 is also coupled to series connected capacitor C218 and resistor R223 to the Enable 2 (EN2) input of the control circuit 82. The resistor R226 is coupled between capacitors C217 and C218. In a situation where the ballast is off, for example where the lamp is out or has been removed, installation of a new lamp passes current through the filaments. Current passes through resistors R222 and R226 to charge capacitor C217. A pulse is thereby sent through capacitor C218 taking pin 9 high through diode D209 to restart the ballast.

A shut off circuit protects the ballast circuit against lamp removal and/or breakage. In the shut off circuit, a pair of resistors R214 and R214A is coupled on the opposite side of parallel resistor network R213 and R213A from the source of MOSFET Q202. A small time constant capacitor C220 is coupled in series with a resistor R225, the anode of which is coupled to diode D209. If the lamp is unexpectedly removed or broken, then a large current is produced through R214 and 214A and with only a short time constant from the resistor capacitor network, the resulting voltage quickly shuts off the control circuit 82 by forward biasing diode D209 and taking the Enable 2 pin (pin 9) high.

A DC sensing circuit 86 (FIG. 5C), similar to the DC sensing circuit 52A and 52B described above with respect to FIGS. 2 and 3, takes the value sensed by the sensor 84 under the series resonant capacitor C219 in the inverter/driver circuit and determines if the representation of the rectified amplitude of the current through the resonant capacitor C219 indicates a lamp that is approaching the end of its useful life. The DC sensing circuit 86 is coupled directly between the resonant capacitor and the sensor 84, in this example. The sensed signal from the series resonant capacitor C219 is passed through resistor R212, through the jumper J4 and the diode D205. A time constant capacitor C209 in parallel with resistor R219 is coupled between the common rail 78 and the middle of the diode D205. If the capacitor C209 charges sufficiently to break down the Zener diodes ZD202, pin 8 of the control circuit 82 goes high, thereby shutting down the ballast. Therefore, the DC sensing circuit 86 takes the representation of the DC rectified amplitude of the current through the resonant capacitor and integrates the signal through analog components to determine when the lamp is approaching the end of its useful life. Additionally, the components making up the DC sensing circuit 86 can be selected and set independently of components of other portions of the ballast circuit.

An AC sensing circuit 88 (FIG. 5D), similar to the AC sensing circuit 50B described above with respect to FIG. 3, takes the integrated value of the upper voltage from the source of the MOSFET Q202 and determines if the representation of the amplitude of the AC current signal has exceeded a predetermined value, indicating that a sufficient number of re-strikes of the lamp have occurred without successfully re-starting the lamp. The control circuit 82 is thereafter shut down. A representation of the current through the MOSFET is taken from the high voltage side of the parallel resistor network R213 and R213A and applied through resistor R211 to diode D207. A time constant capacitor C208 in parallel with resistor R220 is coupled between the low voltage rail 78 and the middle of the diode D207. When the capacitor C208 charges sufficiently, pin 8 of the control circuit 82 goes high, thereby shutting down the ballast. The time constant for the AC sensing circuit 88 is selected, for example through selection of the capacitor C208, to be relatively long. For example, the time constant is selected to be in the range from about 5 to 50 seconds, and in one example may be around 20 seconds.

The DC and AC sensing circuits 86 and 88 are configured to produce a signal substantially instantaneously at the control circuit 82. For example, once the DC sensing circuit 86 determines that the lamp has approached the end of its useful life, the Zener diode ZD202 breaks down and a high signal is immediately applied to pin 8 of the control circuit, which then shuts down the ballast. Additionally, when the AC sensing circuit 88 determines that the selected number of re-strikes has occurred, the capacitor C208 will have charged sufficiently to forward bias the diode D207 and apply a high signal to pin 8 of the control circuit 82. When pin 8 goes high, the ballast shuts down. Therefore, the control circuit can respond immediately when the lamp has reached the end of its useful life, or when re-strike number has been reached. These functions can be accomplished without the use of a microprocessor, for example.

Figure 5A:
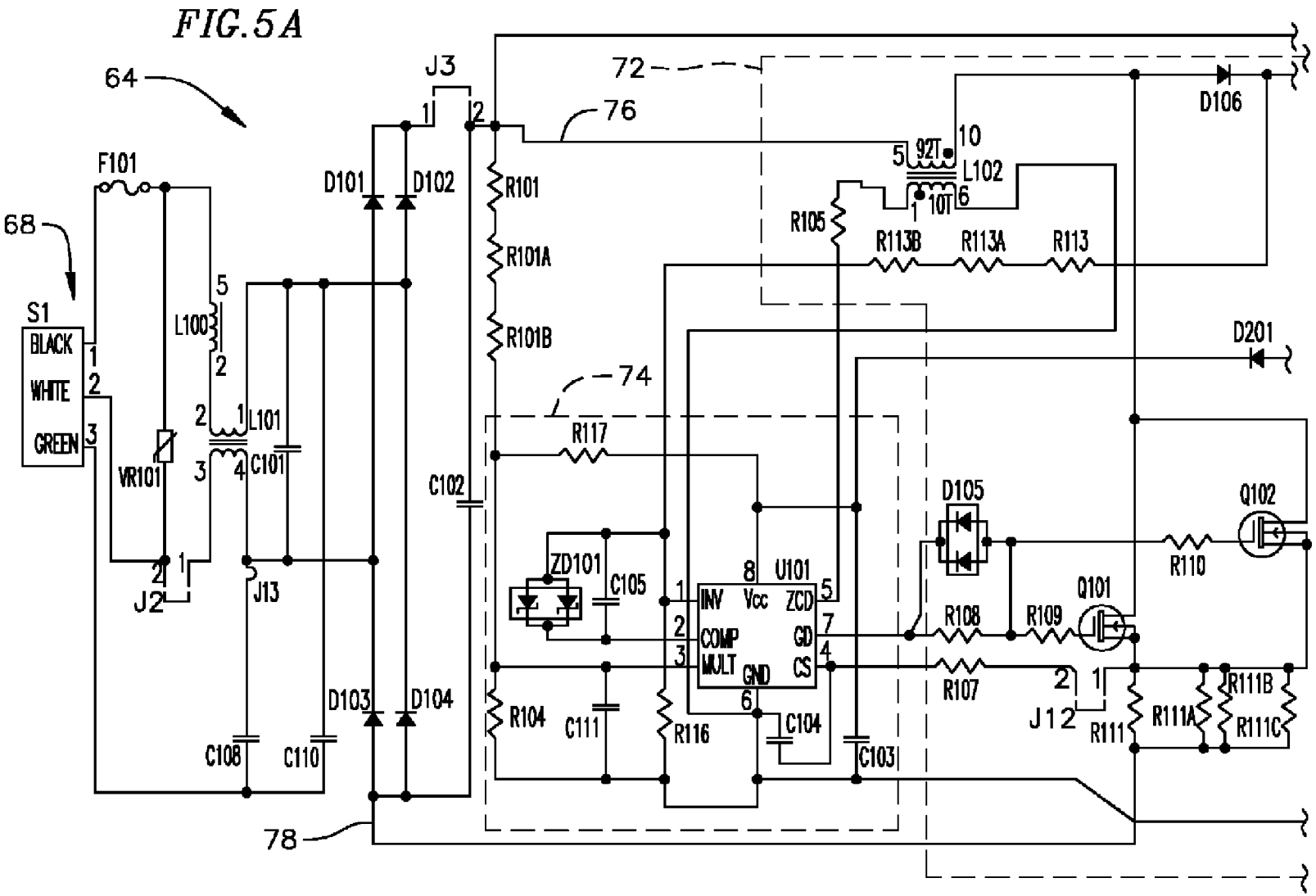
FIGS. 5A-B is a schematic of a ballast circuit having an end-of-lamp life circuit and a separate re-strike monitoring circuit.
Figure 5B:
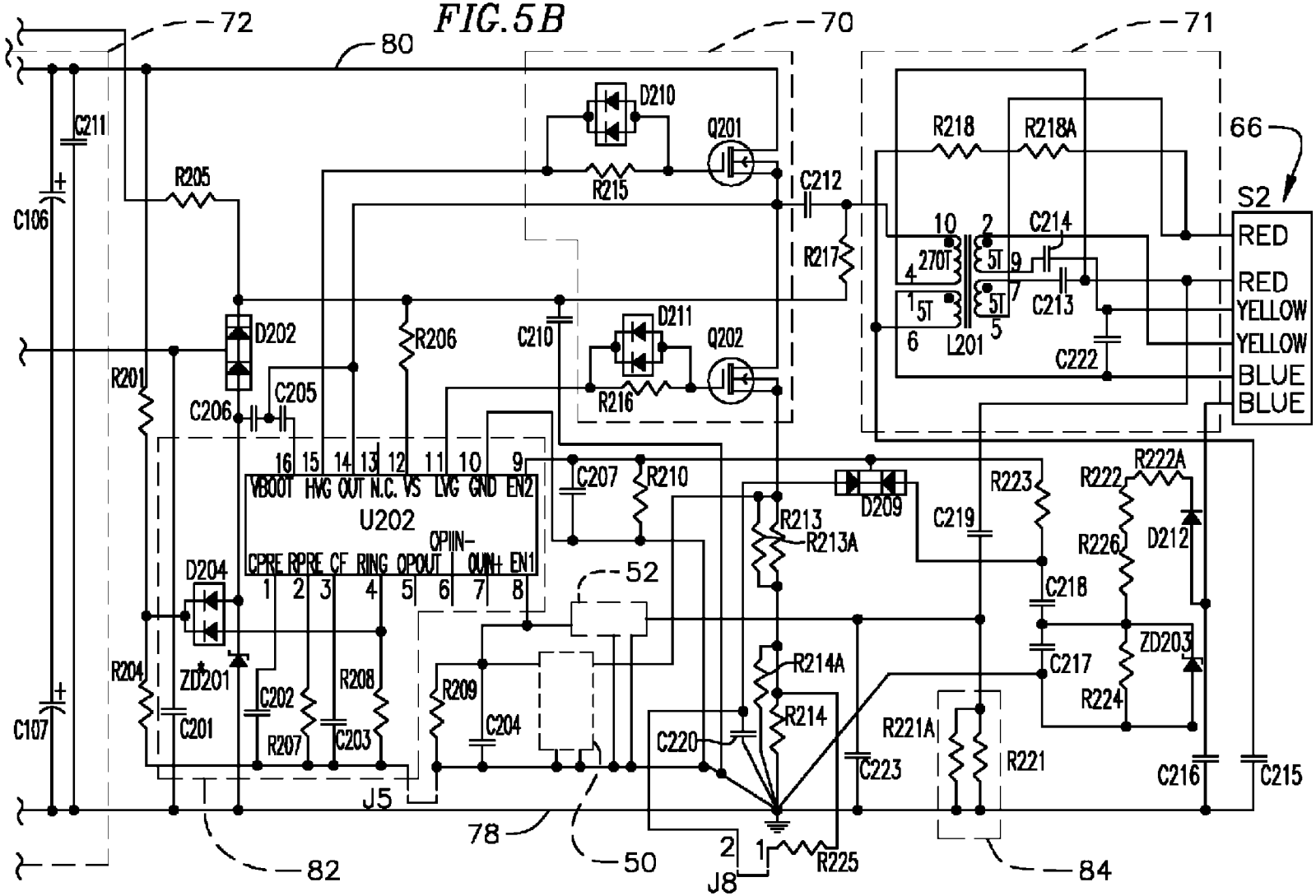
Figure 5C:
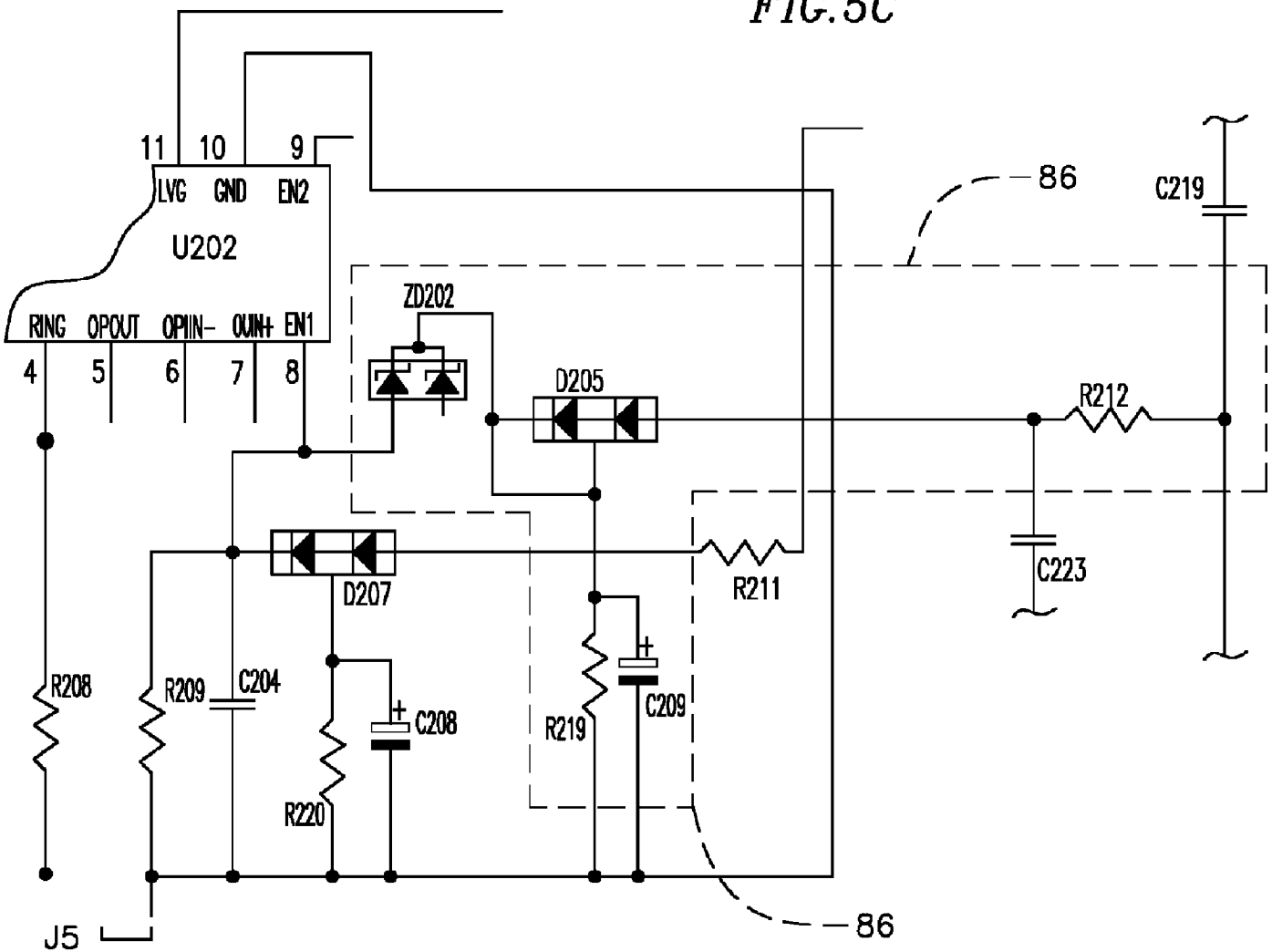
FIG. 5C is a detailed schematic showing a portion of the ballast circuit shown in FIG. 5B showing a detail of an example DC Sensing Circuit.
Figure 5D:
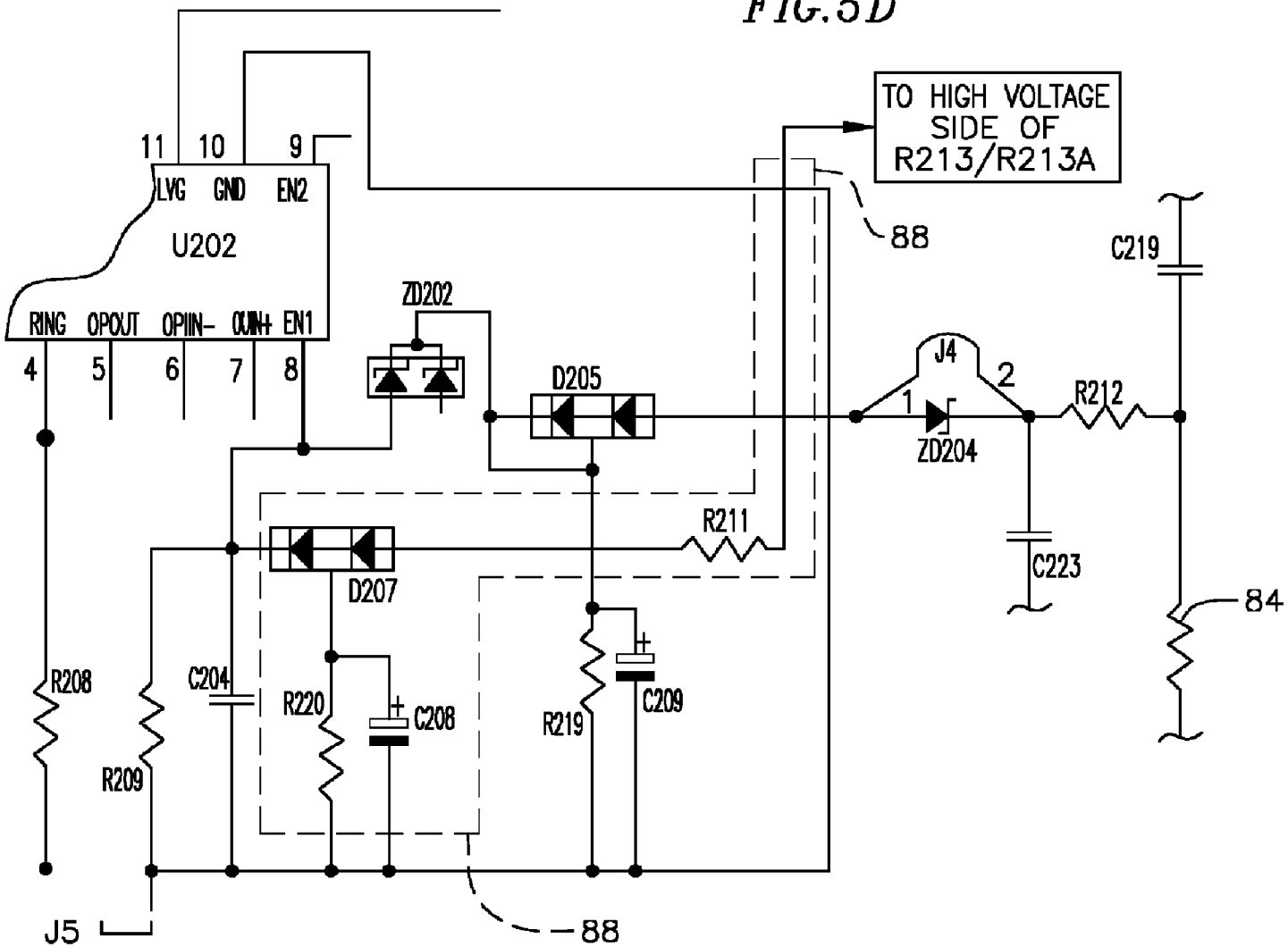
FIG. 5D is a detailed schematic showing a portion of the ballast circuit shown in FIG. 5B showing a detail of an example Slow AC Sensing Circuit and Pulse Accumulation circuit.
Figure 5E:
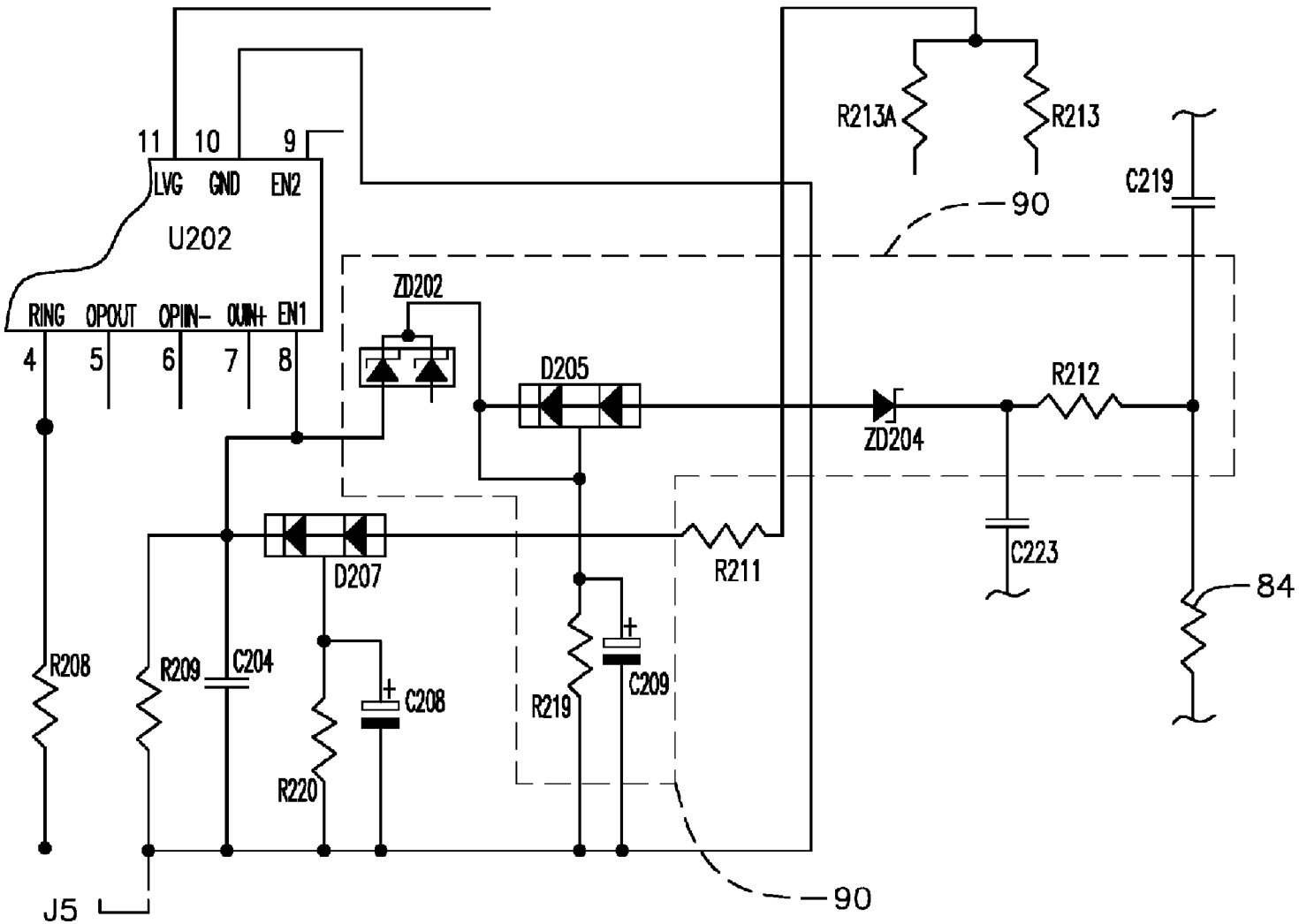
FIG. 5E is a detailed schematic showing a portion of the ballast circuit shown in FIG. 5B showing a detail of an example pulse accumulation circuit.

In another example of a ballast protection circuit, represented in FIG. 5E, a pulse accumulation circuit 90, similar to the pulse accumulation circuit 52C of FIG. 4, can be used to protect the ballast from multiple re-strikes. The pulse accumulation circuit 90 takes the value sensed by the sensor 84 under the series resonant capacitor C219 in the inverter/driver circuit and determines if a number of re-strike attempts have occurred in a predetermined time interval. The pulse accumulation circuit 90 is coupled directly between the resonant capacitor and the sensor 84, in this example. The sensed signal from the series resonant capacitor C219 is passed through the resistor R212 and applied to the Zener diode ZD204. With a high enough voltage, such as when the ballast is trying to restart a de-gassed lamp, the Zener diode ZD204 is broken down and the peaks of the high voltages passing the Zener diode forward bias the diode D205 and charge the capacitor C209. The capacitor C209 charges only with those portions of the high voltage peaks that passed the Zener diode ZD204. The capacitor C209 charges up with the predetermined number of flashes, for example 5 flashes, over the predetermined length of time, such as that time over which the control circuit 82 re-tries starting the lamp five times. When the capacitor C209 is sufficiently charged, the Zener diode ZD202 breaks down, sending a signal to pin 8 of the control circuit 82. Therefore, the pulse accumulation circuit 90 takes the representation of the voltage magnitude on the resonant capacitor and integrates the signal through analog components to determine the number of re-strike attempts. The components making up the pulse accumulation circuit 90 can be selected and set independently of components of other portions of the ballast circuit. Additionally, the ballast can be selectively shutdown immediately by applying the high signal to pin 8 of the control circuit 82.

AC and DC end of lamp life sensing can be carried out using the components in the circuit described above with respect to sensing circuit 50B in FIG. 5D. The analog components are identical, possibly with different values, examples of which are presented below. The signal passing through resistor R211 includes information representing both AC rectifying end of life and DC rectifying end of life. The voltage at resistor R213 and resistor R213A rises as the lamp approaches its AC and its DC end of life, because the output voltage of the inverter increases. As the inverter current increases, the voltage drop across resistors R213 and R213A increases. The signal at the resistors goes through resistor R211 and is rectified by the diode D207. The capacitor C208 then charges up and when the inverter current gets large enough for a sufficiently long period of time, the diode D207 forward biases and pin 8 goes high on the control circuit 82. These functions can be accomplished without the use of a microprocessor, for example.

Considering the operation of the ballast 64 shown in FIGS. 5A and 5B in more detail, the capacitor C203 is a time constant capacitor for setting the frequency of oscillation of the inverter circuit 70, while the resistor R208 sets the running frequency of the ballast. Resistor R207 sets the pre-heat frequency for the lamp filaments, while capacitor C202 determines the duration of the preheat time. When the rail voltage decreases, a circuit is provided to increase the frequency of the high voltage AC signal. Specifically, resistors R201 and R204 divide the voltage between the high and low voltage rails, and the resulting divided voltage is applied to diode D204. When the voltage goes down, the diode D204 is turned on so that resistors R204 and R208 are coupled in parallel, and so that the frequency goes up when the rail voltage goes down. Therefore, fluctuations in the rail voltage are smoothed out and the lamp light output is dimmed while the rail voltage is prevented from dropping as much as it would have done, thereby allowing some dim light production even if the rail voltage decreases.

The high side driver floating reference OUT (pin 14) of the control circuit 82 is coupled to the center point between the transistors Q201 and Q202 of the half bridge 70 and also between capacitors C205 and C206. The other side of capacitor C206 is coupled between Zener diode ZD201 and diode D202, the three of which serve as a charge pump to provide auxiliary power of about 15 volts for the control circuit 82 to the low voltage rail.

A DC path is provided through R217 through each of the filaments. Specifically, current flows into pin 10 of inductor L201 and through the red conductors and their associated filament and through resistors R218A and R218. DC current flows from the series resistors through pin 6 of the inductor L201 and through the blue conductors and their associated filaments. Therefore, when a lamp is installed, current flows through the filaments and charges capacitor C216. Capacitor C216 is limited in voltage to about 9V by zener ZD203. Resistors R222, R222A and R226 (which are used for power cross to ground fault conditions) conduct the C216 signal through the diode D212 to charge up C217. Resistor R224 is used to remove the voltage across C217 after lamps or power have been removed so that the circuit is ready to sense lamp replacement. Zener diode ZD203 (approximately nine volts) clamps the voltage across C217 even in high voltage fault conditions, because all the voltage is dropped across R222A, R222 and R226. When a lamp is replaced, the voltage on C217 rises abruptly and a rising pulse is transmitted across capacitor C218 which is conducted through diode D209 and causes pin 9 (EN2) to go high. Resistor R223 is present to bleed off the charge across C218 afterwards, readying the circuit for another operation. The ballast is then temporarily shut off leading to a new restart cycle. As will be discussed more fully below, multiple restarts can be limited in a predetermined way, to prevent lights from flashing in the ceiling in an annoying manner when a lamp degasses.

During normal lamp operation, sense resistors R214 and R214A are sensing the current coming through the source of MOSFET Q202. The voltage across resistor R214 is applied to resistor R225 and smoothed slightly by capacitor C220 before being applied to diode D209. If current surges through the MOSFET Q202 in response to the lamp being degassed or withdrawn, the sense resistors R214 and R214A sense the current surge and triggers diode D209 to cause the control circuit pin 9 (EN2) to go high, temporarily shutting down the ballast. Because the control circuit is still enabled except for the temporary disable at pin 9, the control circuit 82 outputs a preheat current to the lamp and tries restarting the lamp. Therefore, if excessive current begins flowing through the half bridge 70, for example due to a temporary lamp disconnect, the excessive current will shut down the ballast temporarily through pin 9 and the sense resistors R214 and R214A. These sense resistors and the diode D209 provide a relatively quick response to a sudden fault causing a significant current increase such as may occur with a large voltage increase across the lamp terminals.

In the case of a smaller voltage increase across the lamp over a longer period of time, parallel resistor network R213 and R213A are in series with resistors R214 and R214A producing a relatively high voltage drop across the series resistors to the low voltage rail 78. This higher voltage can be used to effect a shutdown through the control circuit 82 when the higher voltage lasts for a significant amount of time. Therefore, the signal between MOSFET Q202 and the resistors R213 and R213A is applied through resistor R211 to diode D207. The signal is integrated on capacitor C208, which has an approximately 20 second time constant. If the higher voltage signal continues for a long enough time as determined by the capacitor C208 time constant, the input at pin 8 of the control circuit 82 goes high and the ballast is shutdown. Resistor R220 keeps the capacitor C208 from staying charged when the voltage across the lamp has reduced. Resistor R209 sets the magnitude of the signal required to trigger pin 8.

If a lamp is faulty and cannot be re-started after a number of restart or re-strike attempts, the ballast will be shutdown to reduce possible damage to the ballast. For example, start attempts for turning on a fluorescent lamp are generally at higher voltages than normal operating voltage. These higher voltages can be sensed at the output of MOSFET Q202 and the excess voltage can be accumulated on capacitor C208. After approximately 4-8 re-strike attempts, the capacitor C208 will be sufficiently charged to turn off the control circuit at pin 8 if the lamp has not yet started.

The ballast circuit 64 shown in FIG. 5B also senses DC end of lamp life in a fluorescent lamp. The sensor 84, including resistors R221 and R221A, senses the rectified end of life condition of a lamp nearing the end of its useful life. The sensor 84 measures the current through the resonant capacitor C219, which in turn provides an indication of the DC end of life condition of the lamp as it approaches the end of its useful life. The voltage at the sensor 84 is reduced by resistors R212 and R219 through jumper J4 to charge capacitor C209. Capacitor C209 has a relatively long time constant. The capacitor C209 accumulates the signal representing the DC end of life condition of the lamp, and when sufficiently high, the voltage breaks down Zener diode ZD202 causing pin 8 on the control circuit 82 to go high. Capacitor C204 filters out random disturbances on the circuit so that the control circuit 82 is not triggered at pin 8 by such random disturbances.

Zener diode ZD204, if used in the circuit, turns the R212 sensing circuit into an accumulator for restrike flash signals. Because of the presence of its zener breakdown voltage, only the peaks of the highest output voltages will beak down ZD204 and eventually produce a trip. When used in this way, the R211 circuit is used for AC and DC end of life. Since it is only sensing one polarity of the high frequency signals the DC trip point may be different for the two polarities of DC end of life.

In the present examples, the ballast includes a boost circuit such as a power factor correction circuit coupled to the AC input. The power factor correction circuit receives a rectified DC signal from the input circuit. The boost circuit can take a number of configurations, but the example described herein is a power factor correction circuit, such as an L6561 Power Factor Corrector IC described more fully below. The output of the power factor correction circuit is applied to a conventional inverter or driver 38, the output of which is then applied to the load 32. The load 32 in the present examples will be taken to be a conventional fluorescent lamp, for example a fluorescent tube lamp, compact fluorescent lamp or other light source, but it should be understood that other loads can be driven by inverter/driver 38. An inverter can be a series resonant inverter such as that described herein.

TABLE I

EXEMPLARY COMPONENT VALUES (FIGS. 5A-5C & 5E)
2 Lamps, 26 watt

| | |
|---|---|
| C106, C107 | C ELE 22 uF 315 V M 105° C. 10000H BXA |
| | C ELE 33 uF 250 V M 105° C. 10000H CLA |
| C208, C209 | C ELE 22 uF 25 V M 105° C. 2000H CD263 |
| C101, C212 | C MEF 0.1 uF 630 V K MMC |
| C102 | C MEF 0.15 uF 630 V K MMC |
| C219 | C MEF 3300 pF 1.6 KV J MPE |
| C211 | C MEF 2.2 nF 630 V K MMC |
| C215, C216 | C MEF 0.1 uF 250 V K MMC |
| C108, C110 | C CER 2.2 nF 250 V J rms Y cap |
| C222 | C DIS 270 pF 2 KV −5%~10% CC81 |
| C103, C201 | C SMD 0.47 uF 25 V K X7R 0805 |
| C205, C217, C210, C220 | C SMD 0.1 uF 50 V K X7R 0805 |
| C105 | C SMD 1 uF 16 V J X7R 0805 |
| C202 | C SMD 0.68 uF 10 V K X7R 0805 |
| C203 | C SMD 470 pF 50 V J X7R 0805 |
| C204 | C SMD 0.56 uF 16 V J X7R 0805 |
| C207 | C SMD 0.033 uF 50 V K X7R 0805 |
| C218 | C SMD 0.22 uF 50 V K X7R 0805 |
| C223 | C SMD 22 pF 50 V J X7R 1206 |
| C213 | C SMD 0.1 uF 50 V J X7R 1206 |
| C214 | C SMD 0.33 uF 50 V J X7R 1206 |
| C206 | C SMD 820 pF 1 KV K X7R 1206 |
| C104 | N/A |
| R201 | R MF 1M ½ W J RJ15 |
| R205 | R MF 220K ½ W J RJ15 |
| R212 | R MF 150K ½ W J RJ15 |
| R217 | R MF 220K ½ W J RJ15 |
| R218, R218A | R MF 120K ¼ W J RJ14 |
| R104 | R SMD 10K ⅛ W J 0805 |
| R105 | R SMD 47K ⅛ W J 0805 |
| R107 | R SMD 100 ⅛ W J 0805 |
| R108, R215, R216 | R SMD 220 ⅛ W J 0805 |
| R110 | R SMD 10 ⅛ W J 0805 |
| R111 | R SMD 3.6 ⅛ W J 0805 |
| R111A, R111B, R111C | R SMD 3.3 ⅛ W J 0805 |
| R116 | R SMD 5.36K ⅛ W F 0805 |
| R117 | R SMD 390K ⅛ W J 0805 |
| R204 | R SMD 5.1K ⅛ W F 0805 |
| R206 | R SMD 22 ⅛ W J 0805 |
| R207 | R SMD 100K ⅛ W F 0805 |
| R208 | R SMD 54.9K ⅛ W F 0805 |
| R209 | R SMD 470K ⅛ W J 0805 |
| R210 | R SMD 150K ⅛ W J 0805 |
| R211 | R SMD 2.74K ⅛ W F 0805 |
| R219, R223 | R SMD 1M ⅛ W J 0805 |
| R214, R214A | R SMD 1.13 ⅛ W F 0805 |
| R220 | R SMD 4.7M ⅛ W J 0805 |
| R224 | R SMD 2M ⅛ W J 0805 |
| R225, R226 | R SMD 0 ⅛ W J 0805 |
| R101, R101A, R101B, R113, R113A, R113B | R SMD 330K ¼ W F 1206 |
| R109 | R SMD 10 ¼ W J 1206 |
| R213, R213A | R SMD 3.32 ¼ W F 1206 |
| R222, R222A | R SMD 62K ¼ W J 1206 |
| R221, R221A | R SMD 39.2 ½ W F 1210 |
| J2, J7, J10, J11 | JUMPER D0.8 mm * L10 mm |
| J1, J5 | JUMPER D0.8 mm * L7.5 mm |
| J6, J9 | JUMPER D0.8 mm * L20 mm |
| J4, J13 | JUMPER D0.8 mm * L12.5 mm |
| J8 | JUMPER D0.8 mm * L5 mm |
| J3 | JUMPER D0.8 mm * L15 mm |
| J12 | JUMPER D0.8 mm * L17.5 mm |
| VR101 | R VR MYG3-10K300 |
| F101 | FUSE 5 A/250 V |
| D101~D104 | D 1000 V 1 A 1N4007 DO-214AC SMD |
| D105, D204, D209~D211 | D MA3X152E SOT-23 |
| D202, D205, D207 | D MA3X153A SOT-23 |
| D106 | D 600 V 1 A MURS160 T3OSCT-ND |
| D201 | R SMD 300 ¼ W J 1206 |
| D212 | D DIO 100 V 150 mA 1N4148 SOD-80C |
| ZD101 | D ZD 3.9 V J DZ23C3V9 SOT-23 |
| ZD201 | D ZD 16 V J 1N5945A 2 W DO-41 |

TABLE I-continued

| EXEMPLARY COMPONENT VALUES (FIGS. 5A-5C & 5E) 2 Lamps, 26 watt | |
|---|---|
| ZD202 | D ZD 4.7 V J DZ23C4V7 SOT-23 |
| ZD203 | D ZD 16 V J ZM4745A DL-41 |
| ZD204 | N/A |
| Q101, Q102, Q201, Q202 | STD3NK60TZ600 V DPAK |
| L100 | IND 1.35 mH EE13 |
| L101 | IND UU10L5M |
| L102 | IND 0.94 mH EI26 |
| L201 | IND 1.95 mH EI26 |
| U101 | IC L6562DTR ST SO8 |
| U202 | IC L6574 SMD SO-16 |
| S1 | Three pin input connector |
| S2 | Six pin output connector |

TABLE II

| EXEMPLARY COMPONENT VALUES (FIGS. 5A-5B & 5D) 2 Lamps, 13 watt | |
|---|---|
| C106, C107 | C ELE 22 uF 315 V M 105° C. 10000H BXA<br>C ELE 33 uF 250 V M 105° C. 10000H CLA |
| C208, C209 | C ELE 22 uF 25 V M 105° C. 2000H CD263 |
| C101, C212 | C MEF 0.1 uF 630 V K MMC |
| C102 | C MEF 0.15 uF 630 V K MMC |
| C219 | C MEF 1800 PF 1600 V MPE |
| C211 | C MEF 2.2 nF 630 V K MMC |
| C215, C216 | C MEF 0.1 uF 250 V K MMC |
| C108, C110 | C CER 2.2 nF 250 V J rms Y cap |
| C222 | C CER 270 pF 2 KV −5%~10% CC81 |
| C103, C201 | C SMD 0.47 uF 25 V K X7R 0805 |
| C205, C217, C210, C220 | C SMD 0.1 uF 50 V K X7R 0805 |
| C105 | C SMD 1 uF 10 V K X7R 0805 |
| C202 | C SMD 0.68 uF 10 V K X7R 0805 |
| C203 | C SMD 470 pF 50 V J X7R 0805 |
| C204 | C SMD 1 uF 10 V K X7R 0805 |
| C207 | C SMD 0.033 uF 50 V K X7R 0805 |
| C218 | C SMD 0.22 uF 25 V K X7R 0805 |
| C223 | C SMD 22 pF 50 V J X7R 1206 |
| C213 | C SMD 0.1 uF 50 V J X7R 1206 |
| C214 | C SMD 0.33 uF 50 V J X7R 1206 |
| C206 | C SMD 820 pF 1 KV K X7R 1206 |
| C104 | N/A |
| R201 | R MF 1M ½ W J RJ15 |
| R205 | R MF 220K ½ W J RJ15 |
| R212 | R MF 12K ½ W J RJ15 |
| R217 | R MF 220K ½ W J RJ15 |
| R218, R218A | R MF 120K ¼ W J RJ14 |
| R104 | R SMD 10K ⅛ W J 0805 |
| R105 | R SMD 47K ⅛ W J 0805 |
| R107 | R SMD 100 ⅛ W J 0805 |
| R108, R215, R216 | R SMD 220 ⅛ W J 0805 |
| R110 | N/A |
| R111, R111A, R111B, R111C, R225 | R SMD 6.8 ⅛ W J 0805 |
| R116 | R SMD 5.23K ⅛ W F 0805 |
| R117 | R SMD 390K ⅛ W J 0805 |
| R204 | R SMD 5.1K ⅛ W F 0805 |
| R206 | R SMD 22 ⅛ W J 0805 |
| R207 | R SMD 88.7K ⅛ W F 0805 |
| R208 | R SMD 56.2K ⅛ W F 0805 |
| R209 | R SMD 470K ⅛ W J 0805 |
| R210 | R SMD 150K ⅛ W J 0805 |
| R211 | R SMD 33K ⅛ W F 0805 |
| R223 | R SMD 1M ⅛ W J 0805 |
| R219, R224 | R SMD 2M ⅛ W J 0805 |
| R214, R214A | R SMD 2 ⅛ W F 0805 |
| R220 | R SMD 4.7M ⅛ W J 0805 |
| R226 | R SMD 0 ⅛ W J 0805 |
| R101, R101A, R101B, R113, R113A, R113B | R SMD 330K ¼ W F 1206 |
| R109 | R SMD 10 ¼ W J 1206 |
| R213, R213A | R SMD 3.92 ¼ W F 1206 |
| R222, R222A | R SMD 62K ¼ W J 1206 |
| R221, R221A | R SMD 47.5 ½ W F 1210 |

TABLE II-continued

| EXEMPLARY COMPONENT VALUES (FIGS. 5A-5B & 5D) 2 Lamps, 13 watt | |
|---|---|
| J1, J5 | JUMPER D0.8 mm * L7.5 mm |
| J2, J7, J10, J11 | JUMPER D0.8 mm * L10 mm |
| J3 | JUMPER D0.8 mm * L15 mm |
| J6, J9 | JUMPER D0.8 mm * L20 mm |
| J13 | JUMPER D0.8 mm * L12.5 mm |
| J8 | JUMPER D0.8 mm * L5 mm |
| J12 | JUMPER D0.8 mm * L17.5 mm |
| J4 | N/A |
| VR101 | R VR MYG3-10K300 |
| F101 | FUSE 5 A/250 V |
| D101~D104 | D 1000 V 1 A 1N4007 DO-214AC SMD |
| D105, D204, D209~D211 | D 80 V 100 mA MA3X152E SOT-23 |
| D202, D205, D207 | D 80 V 100 mA MA3X153A SOT-23 |
| D106 | D 600 V 1 A MURS160 T3OSCT-ND |
| D201 | R SMD 300 ¼ W J 1206 |
| D212 | D DIO 75 V 150 mA LL4148 SOD-80C |
| ZD101 | D ZD 3.9 V J DZ23C3V9 SOT-23 |
| ZD201 | D ZD 16 V J ZY16B 2 W DO-41 |
| ZD202 | D ZD 4.7 V J DZ23C4V7 SOT-23 |
| ZD203 | D ZD 16 V J ZM4745A DL-41 |
| ZD204 | D ZD 3.9 V ½ W J BZX55 DO-35 |
| Q101, Q201, Q202 | STD3NK60TZ600 V DPAK |
| Q102 | N/A |
| L100 | IND 1.35 mH EE13 |
| L101 | IND 5 mH UU10L5M |
| L102 | IND 1.67 mH EI26 |
| L201 | IND 3.5 mH EI26 |
| U101 | IC L6562DTR ST SO8 |
| U202 | IC L6574 SMD SO-16 |
| S1 | Three pin input connector |
| S2 | Six pin output connector |

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A fluorescent lamp ballast comprising:

an input circuit;

a control circuit coupled to the input circuit for receiving input from the input circuit;

a series resonant circuit for receiving a driving signal based on input from the input circuit under control of the control circuit, the series resonant circuit having a resonant capacitor;

a sensing resistance coupled to the series resonant circuit and coupled in series with the resonant capacitor; and a high voltage sensing circuit coupled between the series resonant circuit and the sensing resistance, wherein the voltage sensing circuit has a time constant greater than one minute in the voltage sensing circuit.

2. The ballast of claim 1 wherein the control circuit includes a lamp preheat circuit.

3. The ballast of claim 1 wherein the control circuit includes an integrated circuit.

4. The ballast of claim 1 wherein the series resonant circuit includes an inductor in series with a capacitor.

5. The ballast of claim 4 wherein the sensing resistance is coupled in series with the capacitor.

6. The ballast of claim 5 wherein the high voltage sensing circuit includes a sensing circuit coupled between the capacitor and the sensing resistance and providing an input to the control circuit.

7. The ballast of claim 6 wherein the sensing circuit includes an integrating capacitor.

8. The ballast of claim 1 further including a lamp AC sensing circuit.

9. The ballast of claim 8 further including an oscillation circuit and wherein the lamp AC sensing circuit is coupled to the oscillation circuit.

10. The ballast of claim 9 further including a resistance element coupled between the oscillation circuit and a low voltage main and wherein the AC sensing circuit is coupled between the resistance element and the oscillation circuit.

11. The ballast of claim 10 further including an integration capacitor coupled to the AC sensing circuit.

12. The ballast of claim 1 wherein the high voltage sensing circuit includes a sensor for sensing a voltage rise above a predetermined level.

13. The ballast of claim 12 wherein the sensor includes a voltage threshold detector.

14. The ballast of claim 13 wherein the sensor is a zener diode.

15. The ballast of claim 12 further including a second sensing circuit.

16. The ballast of claim 15 wherein the second sensing circuit is coupled to an inverter circuit.

17. The ballast of claim 15 wherein the second sensing circuit includes an AC sensing circuit.

18. The ballast of claim 15 wherein the second sensing circuit includes a DC sensing circuit.

19. The ballast of claim 15 wherein the second sensing circuit includes an AC sensing circuit and a DC sensing circuit.

20. The ballast of claim 19 wherein the AC sensing circuit and the DC sensing circuit are coupled to the control circuit at a common input.

21. The ballast of claim 15 wherein the series resonant circuit includes an output and further including a third sensing circuit coupled to the output.

22. The ballast of claim 21 wherein the third sensing circuit includes a capacitive circuit.

23. The ballast of claim 21 wherein the third sensing circuit includes an output coupled to an input of the control circuit.

24. The ballast of claim 23 wherein the high voltage sensing circuit includes an output coupled to a second input of the control circuit.

25. The ballast of claim 1 wherein the high voltage sensing circuit includes a voltage threshold detector.

26. The ballast of claim 1 further including an analog comparator for determining when a voltage sensed by the high voltage sensing circuit has reached a predetermined value.

27. The ballast of claim 26 wherein the analog comparator is configured to immediately produce a response from the control circuit when the voltage sensed by the high voltage sensing circuit has reached the predetermined value.

28. The ballast of claim 1 wherein the control circuit is other than a microprocessor.

29. The ballast of claim 1 wherein the high voltage sensing circuit has a time constant of at least five seconds.

30. A fluorescent lamp ballast comprising:

an input circuit;

a control circuit for receiving input from the input circuit;

an oscillation circuit receiving input from the control circuit;

a series resonant circuit controlled by the control circuit and coupled to an output for applying an alternating current signal to a load;

a DC sensing circuit coupled to the series resonant circuit; and a re-strike monitoring circuit coupled between the oscillation circuit and the control circuit, wherein the DC sensing circuit includes a first resistance element comprising a first path and wherein the re-strike monitoring circuit includes a second resistance element comprising a second path separate from the first path.

31. The ballast of claim 30 wherein the oscillation circuit is a half bridge rectifying circuit.

32. The ballast of claim 30 wherein the DC sensing circuit includes the resistance element coupled to a resonant capacitor in the series resonant circuit.

33. The ballast of claim 30 wherein the first and second resistance elements are applied to a common input for the control circuit.

34. The ballast of claim 30 wherein the DC sensing circuit is an analog circuit.

35. The ballast of claim 30 wherein the re-strike monitoring circuit is an analog circuit.

36. The ballast of claim 30 wherein the DC sensing circuit and the re-strike monitoring circuit are separate circuits.

37. A fluorescent lamp ballast comprising:

an input circuit;

a control circuit receiving an input from the input circuit;

an inverter circuit receiving input from the control circuit;

a series resonant circuit on an output of the inverter circuit; and first and second sensing circuits wherein the first sensing circuit senses an AC end of lamp life parameter in the inverter circuit and applies a first signal to the control circuit, and wherein the second sensing circuit sense a DC end of lamp life parameter in the series resonant circuit and applies a second signal to the control circuit.

38. The ballast of claim 37 further including a resistance sensor coupled in series to the resonant circuit and coupled to the second sensing circuit.

39. The ballast of claim 37 wherein the first sensing circuit includes an integrating capacitor.

40. The ballast of claim 37 wherein the first circuit senses an AC end of lamp life parameter.

41. The ballast of claim 37 wherein the first circuit senses a DC end of lamp life parameter.

42. The ballast of claim 37 wherein the second circuit senses a DC end of lamp life parameter.

43. The ballast of claim 37 wherein the second circuit senses a pulse accumulation parameter.

44. A fluorescent lamp ballast comprising:

an input circuit;

a control circuit for receiving an input from the input circuit;

an inverter circuit receiving input from the control circuit;

a resonant circuit on an output of the inverter circuit;

an AC sensing circuit coupled to the inverter circuit;

a DC sensing circuit coupled to the resonant circuit and responsive to the current through the resonant circuit; and a pulse accumulation circuit coupled to the control circuit for providing an input to the control circuit.

45. The ballast of claim 44 wherein the pulse accumulation circuit is coupled to the inverter circuit.

46. A fluorescent lamp ballast comprising:

an input circuit;

a control circuit for receiving an input from the input circuit;

an inverter circuit receiving input from the control circuit;

a resonant circuit on an output of the inverter circuit;

an AC sensing circuit coupled to the inverter circuit; and a pulse accumulation circuit coupled to the resonant circuit.

47. The ballast of claim 46 further including a DC sensing circuit coupled to the inverter circuit and to the control circuit for providing an input to the control circuit.

48. A fluorescent lamp ballast comprising:

an input circuit;

a control circuit for receiving an input from the input circuit;

an inverter circuit receiving input from the control circuit;

a resonant circuit on an output of the inverter circuit;

a pulse accumulation circuit coupled to the inverter circuit; and a DC sensing circuit coupled to the resonant circuit.

49. The ballast of claim 48 further including an AC sensing circuit coupled to the control circuit for providing an input to the control circuit.

50. A lamp ballast comprising:

an input circuit;

an output circuit;

a control circuit for receiving an input from the input circuit;

a series resonant inverter driver circuit coupled between the input circuit and the output circuit;

a pulse counting circuit coupled to a resistor coupled between the series resonant inverter circuit and a common rail.

51. The lamp ballast of claim 50 wherein the pulse counting circuit includes a zener diode.

52. The lamp ballast of claim 50 wherein the pulse counting circuit includes a capacitive circuit.

53. The lamp ballast of claim 50 wherein the pulse counting circuit includes an output coupled to the control circuit.

54. The ballast of claim 50 further including an AC sensing circuit and a DC sensing circuit coupled between the series resonant inverter driver circuit and the control circuit.

55. The ballast of claim 54 wherein each of the AC sensing circuit and the DC sensing circuit include a respective resistor capacitor circuit.

56. The ballast of claim 50 further including a relamp detection circuit.

57. A lamp ballast comprising:

an input circuit;

an output circuit;

a control circuit for receiving an input from the input circuit;

a series resonant inverter driver circuit coupled between the input circuit and the output circuit;

at least first, second and third discreet sensing circuits, wherein the first sensing circuit is a fast AC sensing circuit, the second circuit is a DC end-of-lamp life sensing circuit configured to respond to a high frequency current in the series resonant inverter driver circuit and the third circuit is an AC end-of-lamp life sensing circuit.

58. A ballast circuit comprising:

an input circuit;

an output circuit;

a control circuit;

an inverter driver circuit between the input circuit and the output circuit;

a resonant capacitor coupled to a common rail between the input circuit and the output circuit;

a voltage level sensor coupled to the inverter driver circuit by a first end being coupled between the resonant capacitor and the common rail;

an end of lamp life sensor coupled between the voltage level sensor and the control circuit; and an integrating capacitor configured to integrate voltage of the inverter driver circuit over time to provide the control circuit with an indication of a number of restrikes applied to the lamp.

59. The ballast circuit of claim 58 wherein the resonant capacitor is coupled to the common rail through a component.

60. The ballast circuit of claim 59 wherein the component is a resistor element.

61. The ballast circuit of claim 58 wherein the voltage level sensor includes a Zener diode.

62. The ballast circuit of claim 61 further including a resistor coupled between the Zener diode and the resonant capacitor.

63. The ballast circuit of claim 61 further including a diode coupled between the Zener diode and the integrating capacitor.

64. The ballast circuit of claim 58 wherein the end of lamp life sensor includes an integrating capacitor.

65. The ballast circuit of claim 58 wherein the end of lamp life sensor is configured to detect AC end of lamp life.

66. The ballast circuit of claim 58 wherein the end of lamp life sensor is configured to detect DC end of lamp life.

67. The ballast circuit of claim 58 wherein the end of lamp life sensor is configured to detect re-strike attempts in the ballast.

68. The ballast circuit of claim 58 wherein the end of lamp life sensor is configured to detect at least two of AC end of lamp life, DC end of lamp life, and re-strike attempts in the ballast.

* * * * *